US010190752B2

(12) United States Patent
Wright

(10) Patent No.: US 10,190,752 B2
(45) **Date of Patent: *Jan. 29, 2019**

(54) LUMINAIRE MOUNTING SYSTEM

(71) Applicant: Cooper Technologies Company, Houston, TX (US)

(72) Inventor: Timothy Wright, Peachtree City, GA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/820,126

(22) Filed: Nov. 21, 2017

(65) Prior Publication Data

US 2018/0156425 A1 Jun. 7, 2018

Related U.S. Application Data

(63) Continuation of application No. 14/699,915, filed on Apr. 29, 2015, now Pat. No. 9,835,314.

(51) Int. Cl.

| | |
|---|---|
| ***F21V 21/08*** | (2006.01) |
| ***F21V 17/10*** | (2006.01) |
| ***F21V 21/02*** | (2006.01) |
| ***F21S 8/00*** | (2006.01) |
| ***H01R 31/06*** | (2006.01) |
| ***F21V 21/002*** | (2006.01) |
| ***F21V 21/116*** | (2006.01) |
| *F21V 23/06* | (2006.01) |

(Continued)

(52) U.S. Cl.

CPC ..... *F21V 17/10* (2013.01); *F21S 8/03* (2013.01); *F21V 21/002* (2013.01); *F21V 21/02* (2013.01); *F21V 21/116* (2013.01); *H01R 31/06* (2013.01); *F21S 8/08* (2013.01); *F21V 23/0464* (2013.01); *F21V 23/06* (2013.01); *F21W 2131/103* (2013.01); *F21Y 2115/10* (2016.08)

(58) Field of Classification Search

CPC ..... F16M 13/00; F21S 8/03; F21S 8/08
USPC ..... 403/381; 175/58; 248/220.21, 223.41, 248/223.51, 221.61, 222.13, 218.4–219.3; 362/431

See application file for complete search history.

(56) References Cited

U.S. PATENT DOCUMENTS

| | | |
|---|---|---|
| D220,778 S | 5/1971 | Jablonski et al. |
| D391,659 S | 3/1998 | Gaskins |

(Continued)

OTHER PUBLICATIONS

D-Series Size 1. LED Wall Luminaire Lithonia Lighting. Jan. 28, 2015.

(Continued)

*Primary Examiner* — Evan Dzierzynski
*Assistant Examiner* — Keith G Delahoussaye
(74) *Attorney, Agent, or Firm* — King & Spalding LLP

(57) ABSTRACT

A luminaire mounting system can accommodate mounting a luminaire to different structures. The luminaire can comprise an adapter, which may be formed into or otherwise associated with a frame of the luminaire, for example. The adapter can provide a mechanical interface to different brackets that are configured for mounting to different structures. The adapter can connect to a first type of bracket that is configured for mounting to a vertically extending pole, to a second type of bracket that is configured for mounting to a horizontally extending pole, and to a third type of bracket that is configured for mounting to a wall or other flat surface.

18 Claims, 6 Drawing Sheets

(51) Int. Cl.

| | |
|---|---|
| *F21S 8/08* | (2006.01) |
| *F21V 23/04* | (2006.01) |
| *F21W 131/103* | (2006.01) |
| *F21Y 115/10* | (2016.01) |

(56) References Cited

U.S. PATENT DOCUMENTS

| | | | |
|---|---|---|---|
| D609,384 | S | 2/2010 | Gray |
| D652,557 | S | 1/2012 | Boissevain |
| 8,254,092 | B2 | 8/2012 | Russell |
| D676,173 | S | 2/2013 | Akinrele |
| D676,174 | S | 2/2013 | Akinrele |
| D676,175 | S | 2/2013 | Akinrele |
| D676,176 | S | 2/2013 | Akinrele |
| D676,177 | S | 2/2013 | Akinrele |
| D676,178 | S | 2/2013 | Akinrele |
| D688,404 | S | 8/2013 | Boissevain |
| D689,233 | S | 9/2013 | Boissevain |
| D695,437 | S | 12/2013 | Johnson |
| D710,046 | S | 7/2014 | Mocek |
| D717,989 | S | 11/2014 | Heim |
| D726,947 | S | 4/2015 | Boyer |
| D729,968 | S | 5/2015 | Szalontai |
| D747,527 | S | 1/2016 | Guercio |
| D766,485 | S | 9/2016 | Ladewig |
| 2008/0198608 | A1 | 8/2008 | Mast |
| 2010/0085751 | A1 | 4/2010 | Shaner |
| 2013/0188371 | A1 | 7/2013 | Ham |
| 2014/0168932 | A1 | 6/2014 | Boomgaarden |
| 2015/0345772 | A1 | 12/2015 | Duckworth |
| 2016/0281967 | A1 | 9/2016 | Hunt, III |

OTHER PUBLICATIONS

Architectural Arm Wall Plate. Installation Instructions for all Arms.
Kim Lighting. Hubbel Lighting Inc. Jul. 16, 2010.

LUMINAIRE MOUNTING SYSTEM

PRIORITY CLAIM

The present application is a continuation application of and claims priority under 35 U.S.C. § 120 to U.S. patent application Ser. No. 14/699,915, filed Apr. 29, 2015, and titled "Luminaire Mounting System". The entire contents of the foregoing application are hereby incorporated herein by reference.

TECHNICAL FIELD

Embodiments of the technology relate generally to luminaires, and more particularly to a luminaire mounting system that supports multiple mounting configurations.

BACKGROUND

Luminaires can be mounted to a wide range of structures. For example, in an outdoor application, a need may arise to mount a luminaire to a pole that extends vertically, to a pole that extends horizontally, or to a wall or other structure that has a flat surface. When using conventional luminaire mounting technology, the installers are often faced with a task that involves making custom bracketing hardware or implementing field modifications to the luminaire or to an ill-suited mounting bracket. Accordingly, conventional approaches to luminaire mounting are often unwieldy, cumbersome, labor intensive, or inefficient.

In view of these and other shortcoming in the art, improved technology for mounting luminaires is needed. Need exists for a flexible approach to luminaire mounting. Need further exists for a mounting system that provides compatibility with multiple structures, for example with vertical and horizontal poles and with walls and similar structures. Need additionally exits for a mounting system that provides a universal interface for mounting a luminaire to different brackets that support different mounting configurations. A capability addressing one or more such needs, or some other related deficiency in the art, would facilitate improved luminaire mounting economics.

SUMMARY

In one aspect of the disclosure, a luminaire comprises an adapter. The adapter may be associated with a frame of the luminaire, for example. The adapter can provide connectivity to multiple types of brackets that may be used for mounting to different structures. For example, the adapter of the luminaire may connect to a first type of bracket if the luminaire is to be mounted to a vertically extending pole. The adapter of the luminaire may connect to a second type of bracket if the luminaire is to be mounted to a horizontally extending pole. The adapter of the luminaire may connect to a third type of bracket if the luminaire is to be mounted to a flat surface.

The foregoing discussion is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

Figure 1A:
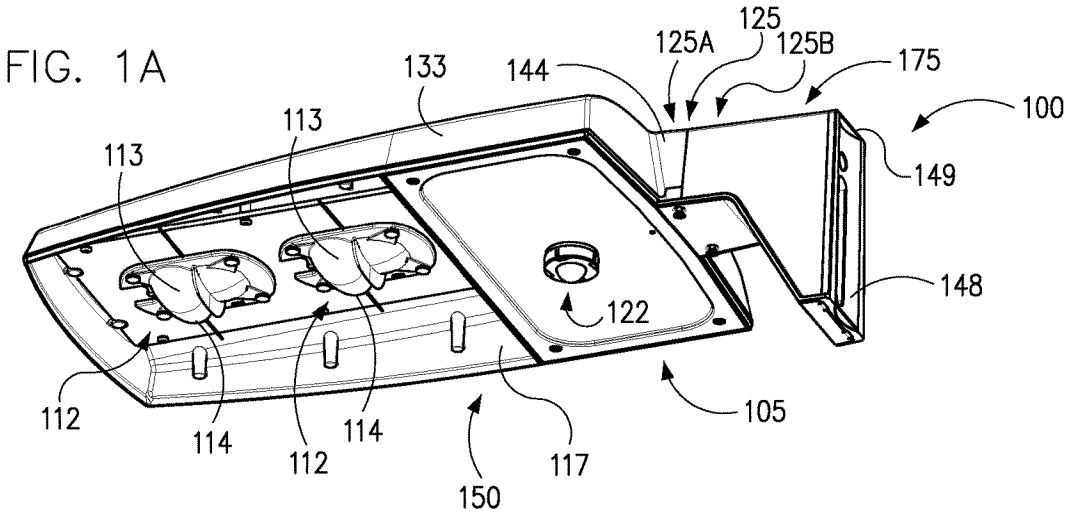
FIGS. 1A, 1B, and 1C (collectively FIG. 1) illustrate three perspective views of an outdoor luminaire and an associated bracket for mounting to a vertically extending pole according to some example embodiments of the present disclosure.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DETAILED DESCRIPTION OF EXAMPLE EMBODIMENTS

A luminaire mounting system can comprise an adapter that connects to different brackets that are configured for mounting a luminaire to different structures, such as in connection with mounting to vertical or horizontal poles, to a mast, to a wall, or to other manmade or natural structures.

The term "adapter," as used herein, generally refers to a connector for joining parts or devices that have different sizes, designs, or configurations to enable them to be fitted together or to work together. For example, an adapter may be used to connect a first device to each of a second device and a third device, where the second and third devices have different sizes, designs, or configurations Some representative embodiments will be described more fully hereinafter with example reference to the accompanying drawings that illustrate embodiments of the technology. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art. The technology will be discussed with reference to FIGS. 1-5. FIGS. 1 and 2 describe using a luminaire with a first representative mounting bracket. FIG. 3 describes using the luminaire with a second representative mounting bracket. FIGS. 4 and 5 describe using the luminaire with a third representative mounting bracket.

Figure 1C:
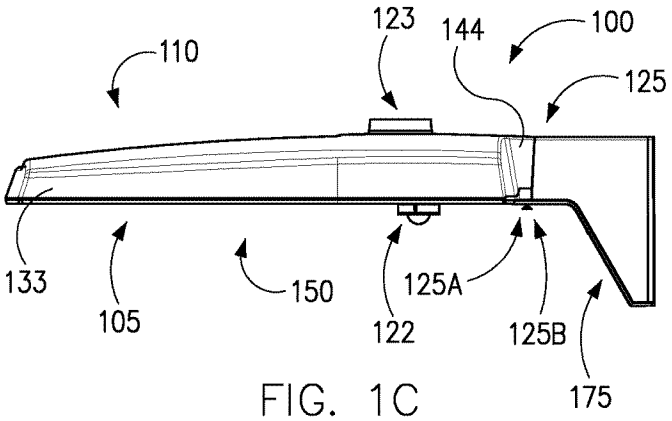
Figure 1B:
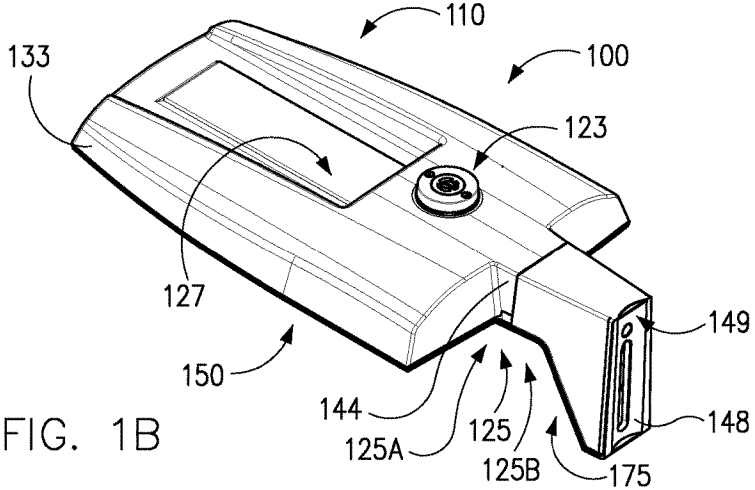
Figure 2B:
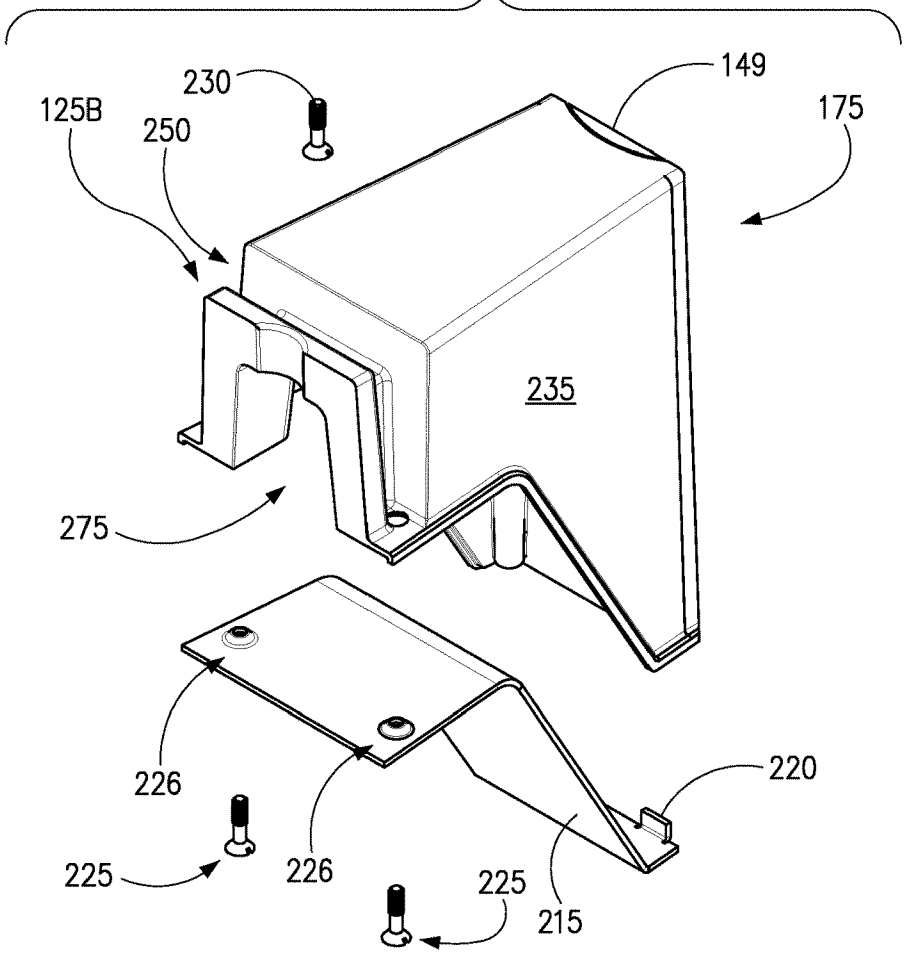
FIGS. 2A, 2B, 2C, and 2D (collectively FIG. 2) illustrate four views of the bracket illustrated in FIG. 1 according to some example embodiments of the present disclosure.
Figure 2A:
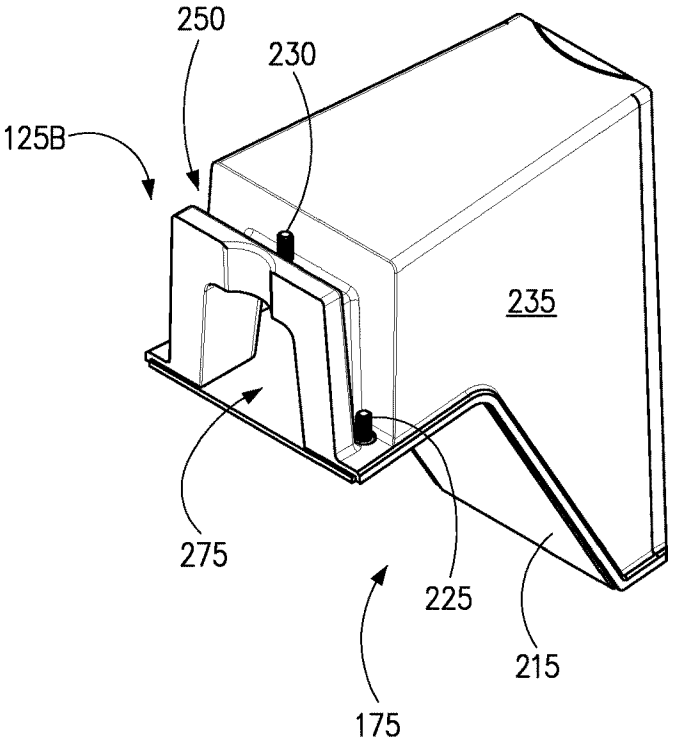
Figure 2D:
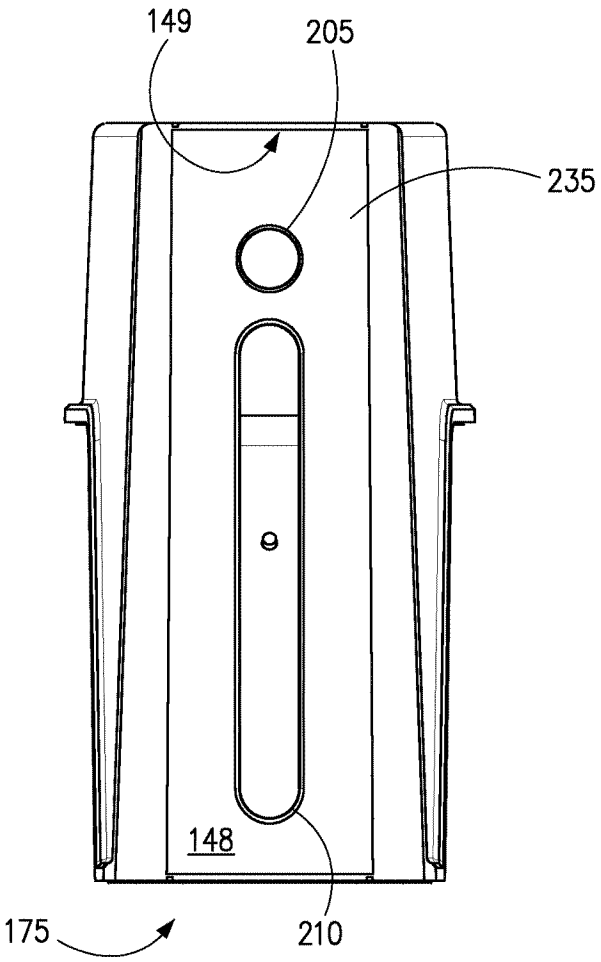
Figure 2C:
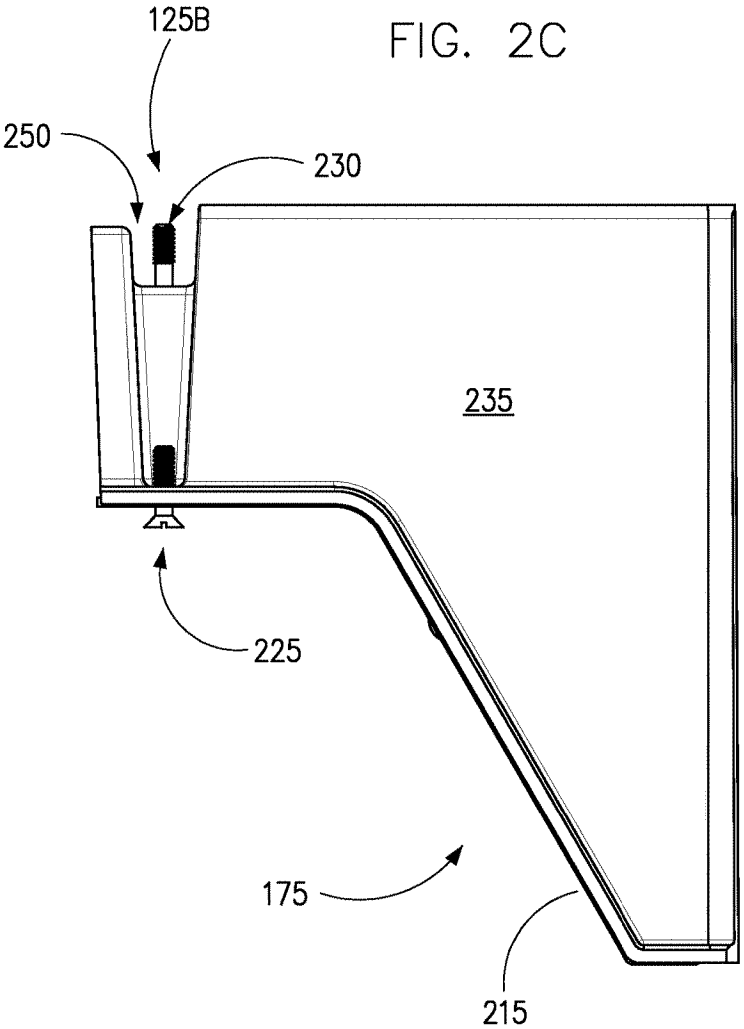

Turning now to FIG. 1, this figure provides three perspective illustrations of a system 100 that comprises an example outdoor luminaire 150 and an associated example bracket 175 for mounting to a vertical pole in accordance with some embodiments of the present disclosure. FIG. 1A provides a perspective view taken from below the outdoor luminaire 150. FIG. 1B provides a perspective view taken from a position behind and above the outdoor luminaire 150. FIG. 1A provides a side view of the outdoor luminaire 150.

As will be discussed in further detail below, the luminaire 150 connects to the illustrated bracket 175 (as well as to other brackets) via a connection system 125. The connection system 125 comprises a bracket-side connector 125B and an adapter 125A that connect with one another. The adapter 125A can be viewed as a luminaire-side connector without limitation. The bracket 175 mounts the luminaire 150 to a structure, and the bracket 175 illustrated in FIGS. 1 and 2 is configured for mounting to a vertically extending pole. The vertically extending pole may be upright or tilted.

As will be further discussed below, the bracket 175 can be lightweight relative to the luminaire 150 and thus can be readily attached to a vertical pole without the luminaire 150. Once the bracket 175 is attached to the pole, the luminaire 150 can be conveniently connected to the bracket 175 via the connection system 125.

In the illustrated example embodiment, the luminaire 150 is configured for overhead outdoor installation, for example as a streetlight. It will be appreciated that the disclosure supports a wide range of luminaire embodiments and lighting applications, both for indoor illumination and for outdoor illumination. Thus, the connection system 125 is applicable to and is compatible with various indoor and outdoor luminaires that can be mounted in many configurations to many types of structures, without limitation.

FIG. 1A shows the underside 105 of the luminaire 150, which emits light into an area to be illuminated. The example luminaire 150 comprises two light sources 112 that each comprise a respective light emitting diode ("LED") 113. In the illustrated embodiment, each light emitting diode 113 comprises a chip-on-board ("COB") light emitting diode. Other embodiments may comprise a cluster of discrete light emitting diodes or another appropriate lighting element, for example.

In addition to the light emitting diode 113, each light source 112 comprises an optic 114 that environmentally protects the associated light emitting diode 113 as well as managing light. The optic 114 can direct light forward, for example to provide an illumination pattern that is biased in a street side direction to cast light preferentially towards a street.

As illustrated, the light sources 112 are mounted to the frame 133 in a recessed area 117 on the underside 105 of the luminaire 150. A sensor 122 is also mounted to the underside 105 of the luminaire 150 and can control light output from the luminaire 150 according to sensor input. In some embodiments, the sensor 122 comprises a motion or infrared sensor for detecting presence of a person below the luminaire. In some embodiments, the sensor 122 detects ambient light.

As shown in FIGS. 1B and 1C, another sensor 123 is mounted to the topside 110 of the luminaire 150. In an example embodiment, the sensor 123 can comprise a photodetector that functions as an ambient light sensor. The sensor 123 can thus trigger the luminaire 150 to turn on at dusk and to turn off when ambient light reaches a threshold level associated with sunrise.

The topside 110 of the luminaire 150 comprises a recessed area 127 in the frame 133 opposite the light sources 112. The recessed area 127 serves to position the topside of the frame 133 close to the light sources 112 to promote efficient transfer of heat from the light sources 112 to the frame 133. Accordingly, the frame 133 can conduct heat away from the light sources 112 to maintain a relatively cool operating temperature. In example embodiments, the frame 133 can be comprised of a metal, for example cast aluminum, or of a thermally conductive plastic or composite material.

The frame 133 of the luminaire 150 comprises an extension 144 that adjoins the bracket 175 at the connection system 125. The bracket side of the connection system 125 will be described in further detail below with reference to FIG. 2 that illustrates the bracket 175 (and the other figures). The luminaire side of the connection system 125 is illustrated in FIGS. 3A and 4A and will be discussed below with reference to those figures, among other places.

Turning now to FIG. 2, this figure provides four illustrations of the example bracket 175 illustrated in FIG. 1 in accordance with some embodiments of the present disclosure. FIG. 2A illustrates a front perspective view of the example bracket 175, taken from the luminaire end of the bracket 175. FIG. 2B illustrates an exploded view of the example bracket 175, taken from essentially the same perspective as the view of FIG. 2A. FIG. 2C illustrates a side view of the bracket 175. FIG. 2D illustrates a view of the bracket 275 taken from the rear, pole-side of the bracket 275.

The bracket 175 comprises a curved surface 148 (see FIGS. 1A, 1B, and 2D) that faces the pole (not illustrated) to which the luminaire 150 is to be mounted. The curved surface 148 thus comprises a mounting surface. In an example embodiment, the curved surface 148 can have a radius of curvature that substantially matches the radius of curvature of the pole. At the top of the curved surface 148, the bracket 175 comprises a lip 149 that can abut the end of the pole to facilitate mechanical alignment during installation and to enhance mechanical coupling between the pole and the bracket 175.

In the illustrated embodiment, the curved surface 148 comprises an aperture 205. The aperture 205 can be sized to receive a bolt for attaching the bracket 175 to the pole, for example. The curved surface 148 of the luminaire 150 further comprises a slot 210. In an example embodiment, the slot 210 is sized to pass electrical lines for powering the luminaire 150. Accordingly, wiring for the luminaire 150 can extend up through a lumen of the pole and can enter the bracket 175 through the slot 210. The electrical lines can further extend through the internal space 275 of the bracket 175 for entry into the luminaire 150 through an opening in the extension 144 the luminaire frame 133 (see opening 353 in FIG. 3A, for example).

The underside of the bracket 175 comprises a cover 215 that an installer can readily remove or secure during luminaire installation. With the cover 215 removed, the installer can readily attach the bracket 175 to the pole and can readily feed the electrical lines through the bracket 175 and into the luminaire 150. In some embodiments, the luminaire 150 can be packaged with pigtail wiring that the installer can feed through the bracket 175. For example, the installer may make an electrical connection between pigtail wiring and utility wiring and stow the connection in the bracket 175. Accordingly, the bracket 175 can provide an enclosure for housing wiring connections or can function as a junction box.

The bracket 175 connects to the luminaire 150 at the bracket-side connector 125B of the bracket 175. The bracket-side connector 125B comprises a groove 250 that extends along two sides and an upper portion of the bracket-side connector 125B. A screw 230 extends through the upper portion of the bracket-side connector 125B and engages threads in a corresponding hole in the extension 144 of the frame 133 of the luminaire 150. The screw 230 thus helps secures the bracket-side connector 125B to the adapter 125A (further discussed below) of the luminaire frame 133.

The cover 215 attaches to the underside of the extension 144 on the frame via two screws 225 and associated apertures 226 in the cover 215. In the illustrated embodiment, at least one tab 220 in the cover 215 extends into the bracket body 235 and further provides alignment and cover retention.

Figure 3C:
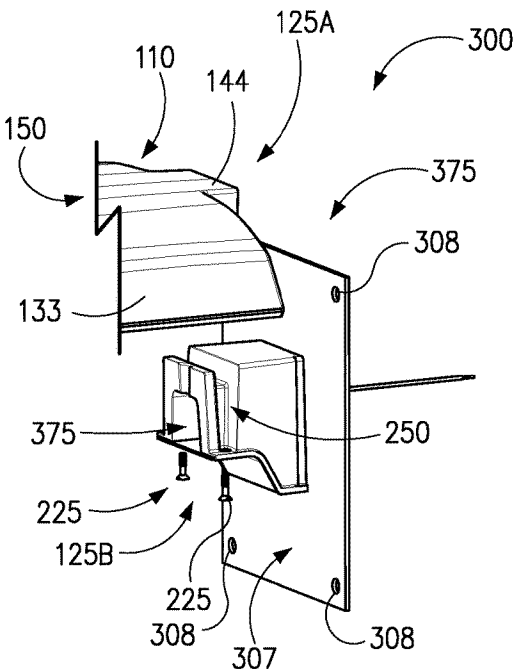
FIGS. 3A, 3B, and 3C (collectively FIG. 3) illustrate three views of the outdoor luminaire and another associated bracket for mounting to a flat structure according to some example embodiments of the present disclosure.
Figure 3A:
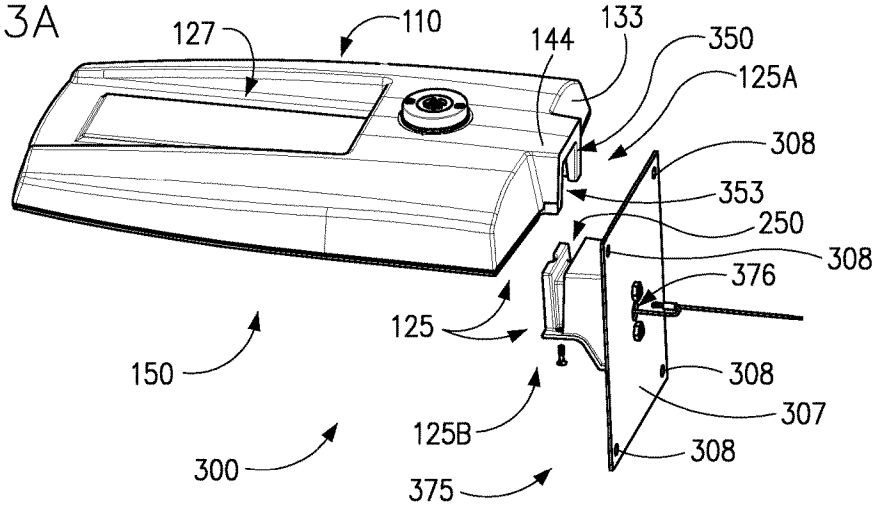
Figure 3B:
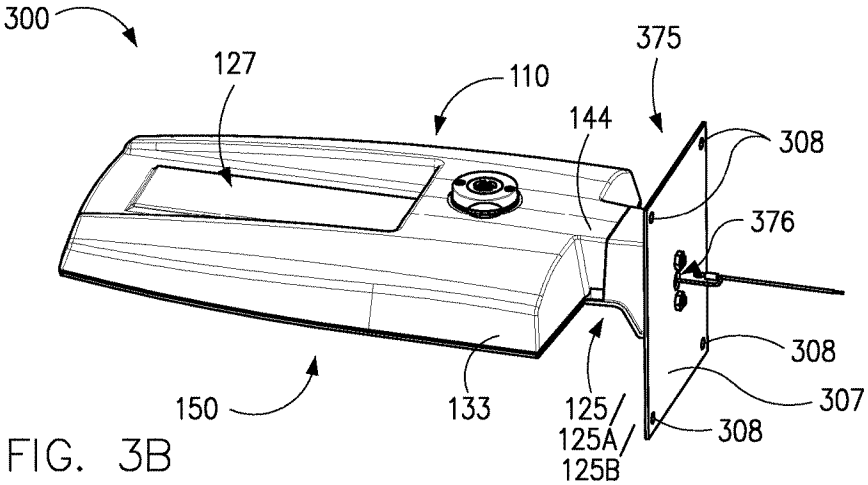
Figure 4A:
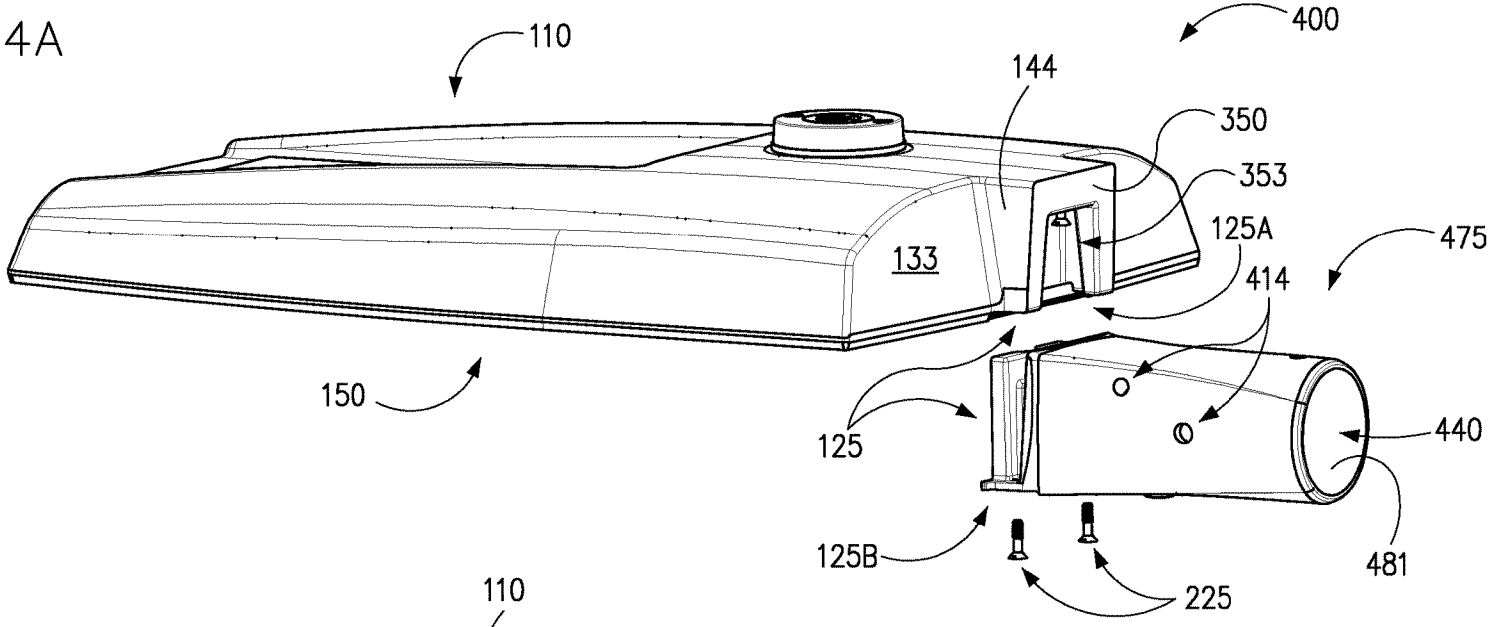
FIGS. 4A and 4B (collectively FIG. 4) illustrate two views of the outdoor luminaire and another associated bracket for mounting to a horizontally extending pole according to some example embodiments of the present disclosure.

Turning now to FIG. 3, this figure provides three perspective illustrations of a system 300 comprising the example outdoor luminaire 150 and another associated example bracket 375 that is configured for mounting to a flat structure in accordance with some embodiments of the present disclosure. FIG. 3A illustrates a first view of the outdoor luminaire 150 separated from the example bracket 375 but aligned for connection, where the view is taken from a front perspective. FIG. 3B illustrates the outdoor luminaire 150 connected to the example bracket 375 via the connection system 125. FIG. 3C illustrates a second view of the outdoor luminaire 150 separated from the example bracket 375 but aligned for connection, where the view is taken from a rear perspective.

In installation, an installer typically fastens the bracket 375 to a wall or other vertical structure while the bracket 375 is separated from the luminaire 150, as illustrated in FIGS. 3A and 3C. For example, bolts or other appropriate fasteners (not illustrated) can extend into the wall (not illustrated) through holes 308 in the rear plate 307 of the bracket 375. The rear plate 307 thus provides a mounting surface.

The installer can feed electrical lines through the aperture 376 at the backside of the rear plate 307 so that the electrical lines extend through the bracket 375. So placed, the electrical lines can extend out of the bracket 375 through the opening 375 in the bracket-side connector 125B, for connection to the luminaire 150. In the illustrated embodiment, the connection system 125 comprises a lumen that accommodates passage of electrical wiring.

Once the bracket 375 is mounted to the wall, the installer can position the luminaire 150 adjacent and above the bracket 375, so that the adapter 125A is oriented directly above the bracket-side connector 125B. With the luminaire 150 in this orientation, the installer can readily lower the luminaire 150 until the adapter 125A and the bracket-side connector 125B connect.

As discussed above with reference to FIGS. 1 and 2, the example bracket-side connector 125B comprises a groove 250 that extends vertically on two sides of the opening 375 as well as above the opening 375. As shown in FIGS. 3A and 4A, the adapter 125A comprises an opening 353 that aligns to the opening 375 of the bracket 375 for passage of electrical lines, as discussed above. The example adapter 125A comprises a protrusion 350 that extends vertically on two sides of the opening 353 as well as above the opening 353. In the illustrated embodiment, the protrusion 350 is formed in the frame 133 of the luminaire 150, specifically as part of the extension 144. While the protrusion 350 is illustrated as integral with the frame 133, other embodiments that are not integral are supported and may be utilized.

The protrusion 350 of the adapter 125A is sized to seat in the groove 250 of the bracket-side connector 125B when the installer lowers the luminaire 150 on the bracket 375 so that the luminaire 150 and the bracket 375 are connected as illustrated in FIG. 3B. In some example embodiments, the protrusion 350 is disposed in the groove 250 to form a dovetail joint. In some example embodiments, the protrusion 350 is disposed in the groove 250 to form a tongue-in-groove joint. The groove 250 is typically but not necessarily oversized with respect to the protrusion 350 to avoid binding and to facilitate luminaire removal in connection with maintenance or replacement. Once the adapter 125A and the bracket-side connector 125B are coupled together, the installer can advance the screws 225 to secure the connection. When the system 300 is configured as illustrated in FIG. 3B, the luminaire 150 can be considered as positioned for long-term operation.

In the embodiment of FIG. 4, the groove 250 is formed in the bracket 375, and the protrusion 350, which seats in the groove 250, is formed in the luminaire 150. However, in some other example embodiments, the groove 250 may be formed in the frame 133 of the luminaire 150, and the protrusion 350 may be formed in the bracket 375.

As will be appreciated by those of skill in the art having benefit of the rich disclosure and teaching provided herein, other appropriate mechanical couplings, interfaces, connections, and joints can be incorporated in place of the illustrated protrusion/groove arrangement. Thus, the illustrated adapter 125A and bracket-side connector 125B that utilizes a groove 250 and a protrusion 350 represents one example form of the connection system 125 and can be replaced with other appropriate forms.

Figure 4B:
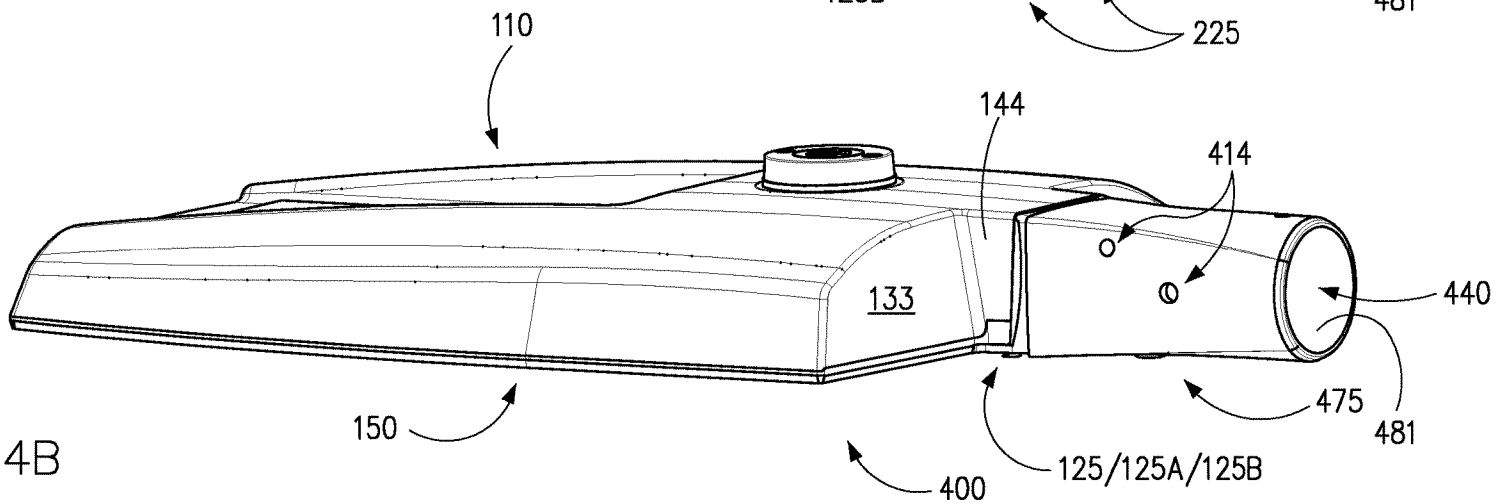

Turning now to FIGS. 4 and 5, other example embodiments will be discussed in further detail. FIG. 4 provides two perspective illustrations of a system 400 comprising the example outdoor luminaire 150 and another associated example bracket 475 that is configured for mounting to a horizontal pole in accordance with some embodiments of the present disclosure. FIG. 4A illustrates the outdoor luminaire 150 separated from the example bracket 475 but aligned for connection. FIG. 4B illustrates the outdoor luminaire 150 connected to the example bracket 475 via the connection system 125.

Figure 5A:
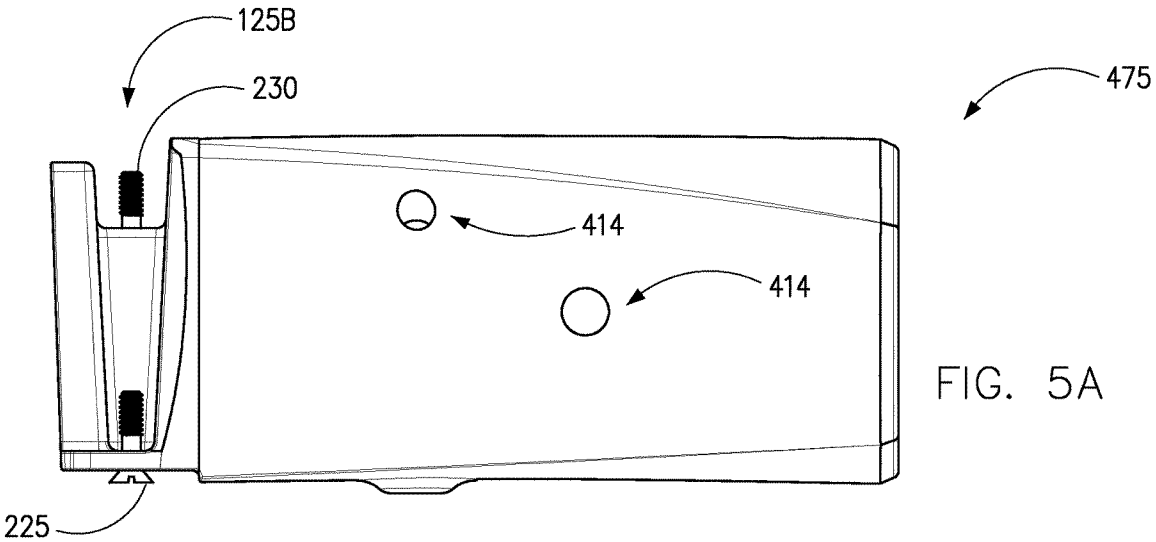
FIGS. 5A, 5B, and 5C (collectively FIG. 5) illustrate three views of the bracket illustrated in FIG. 4 according to some example embodiments of the present disclosure.
Figure 5C:
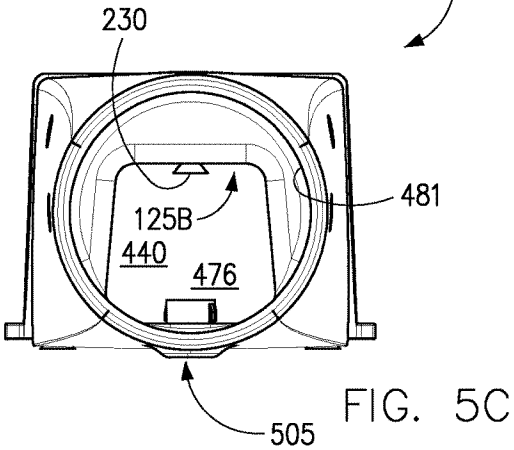
Figure 5B:
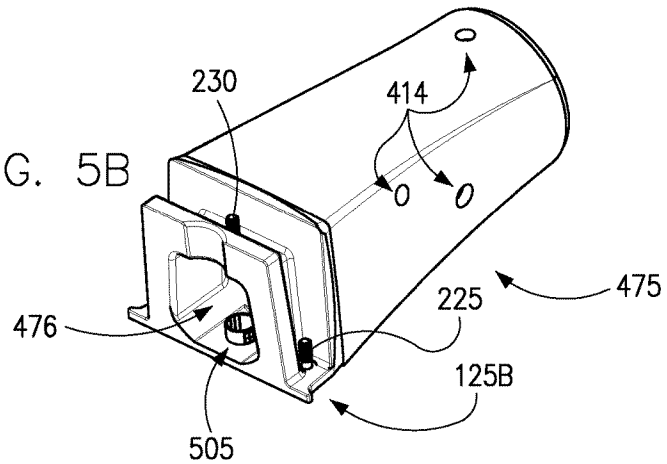

FIG. 5 provides three illustrations of the example bracket 475 illustrated in FIG. 4 in accordance with some embodiments of the present disclosure. FIG. 5A illustrates a side view of the bracket 475. FIG. 5B illustrates a perspective view of the bracket 475 taken from the luminaire side of the bracket 475 and showing the bracket side 125B of the connection system 125. FIG. 5C illustrates an end-on view of the bracket 475 taken from the pole-side end of the bracket 475.

In the configuration of FIG. 4A, the position of the bracket 475 would typically be established by inserting the distal end of a horizontally extending pole into the aperture 440 of the bracket 475. The internal surface 481 of the aperture 440 thus provide a mounting surface. The horizontally extending pole may be level or slanted. The installer can then insert setscrews, pins, or other appropriate elements into the apertures 414 to fix the bracket position and prevent rotation.

Electrical wiring that extends through the lumen of the pole can pass through the aperture 440, the body, and the opening 476 of the bracket 475. The installer can thus efficiently connect an electrical supply to the luminaire 150.

With the luminaire 150 positioned as illustrated in FIG. 4A, the installer can conveniently lower the luminaire 150 until the adapter 125A and bracket-side connector 125B engage and support the luminaire 150. Once the luminaire 150 is so supported, the installer can insert a screwdriver tip (or other appropriate tool) through the port 505 and advance the screw 230 into a corresponding threaded hole in the upper portion of the frame extension 144. The port 505 typically comprises an aperture and an associated plastic plug for sealing the aperture after the threaded screw 230 is tightened. The installer can similarly advance the screws 225 as discussed above. Tightening the screw 230 and the screws 225 thereby sets the connection system 125 for long-term operation.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A luminaire comprising:

a frame that is configured to house a light source in a cavity defined by the frame;

wherein a rear end of the frame comprises:

an extension that is integrally formed with the frame and comprising a wire receiving aperture defined by a protrusion formed in the extension, the protrusion comprising two side walls extending on two sides of the wire receiving aperture and a top wall disposed between the two side walls and extending above the wire receiving aperture, and wherein the extension is configured to secure the frame to a bracket-side connector of:

(a) a first bracket when the frame is mounted to a first mounting surface, (b) a second bracket when the frame is mounted to a second mounting surface, and (c) a third bracket when the frame is mounted to a third mounting surface, and wherein the first mounting surface, the second mounting surface, and the third mounting surface are different from each other; and wherein the protrusion is sized to seat in a corresponding groove defined by the bracket-side connector of: (a) the first bracket when the frame is mounted to the first mounting surface, (b) the second bracket when the frame is mounted to the second mounting surface, and (c) the third bracket when the frame is mounted to the third mounting surface.

2. The luminaire of claim 1, wherein the first mounting surface is a vertically extending pole.

3. The luminaire of claim 2:

wherein to mount the frame to the vertically extending pole: (a) the protrusion of the frame is disposed in a groove defined by the bracket-side connector of the first bracket such that: (i) a first bracket wire receiving aperture aligns with the wire receiving aperture defined by the protrusion of the extension in the frame, and (ii) an opening in the extension aligns with a fastener receiving opening in the first bracket, and (b) a fastener is passed through the fastener receiving opening of the first bracket and the opening of the extension, wherein the first bracket comprises a curved mounting surface disposed at an end that is opposite to the bracket-side connector and a lip disposed at a top end of the curved mounting surface, and wherein the curved mounting surface has a radius of curvature that substantially matches a radius of curvature of the vertically extending pole.

4. The luminaire of claim 1, wherein the second mounting surface is a horizontally extending pole.

5. The luminaire of claim 4:

wherein to mount the frame to the horizontally extending pole: (a) the protrusion of the frame is disposed in a groove defined by the bracket-side connector of the second bracket such that: (i) a second bracket wire receiving aperture aligns with the wire receiving aperture defined by the protrusion of the extension in the frame, and (ii) the hole of the extension aligns with a port in the second bracket, and (b) the fastener is passed through the port of the second bracket and the hole of the extension, wherein the second bracket comprises a pole receiving aperture disposed at an end that is opposite to the bracket-side connector, and a plurality of set screw receiving holes, and wherein the pole receiving aperture receives an end of the horizontally extending pole and is adjusted using one or more set screws inserted through the plurality of set screw receiving holes.

6. The luminaire of claim 1:

wherein the third mounting surface is a flat surface, wherein to mount the frame to a flat surface: (a) the protrusion of the frame is disposed in a groove defined by the bracket-side connector of the third bracket such that a third bracket wire receiving aperture aligns with the wire receiving aperture defined by the protrusion of the extension in the frame, wherein the third bracket comprises a rear plate that is disposed at an end that is opposite to the bracket-side connector, and wherein the rear plate is configured to be attached to the flat surface using a plurality of mounting fasteners.

7. The luminaire of claim 1, wherein the extension provides the frame with a dovetail connection for each of the first bracket, the second bracket, and the third bracket.

8. A bracket for mounting a luminaire, comprising:

a top wall;

side walls extending from opposite edges of the top wall, a rear end disposed at a first end of the top wall and configured for attachment to a mounting structure;

wherein the rear end, the top wall, and the side walls together define a wire receiving aperture;

a front end disposed at a second end that is opposite to the first end of the top wall; and a groove that is disposed between the front end and the rear end, the groove being formed adjacent to and offset from the front end such that the groove divides the bracket between a front end portion and a rear end portion, wherein the groove extends along the side walls and the top wall; and wherein a portion of the top wall that defines the groove comprises a hole that is configured to receive a fastener therethrough to couple the bracket to a frame of a light fixture comprising a light source.

9. The bracket of claim 8, wherein the groove is sized to receive a protrusion on the frame of the light fixture.

10. The bracket of claim 8, wherein the mounting structure comprises a pole that extends vertically.

11. The bracket of claim 8, wherein the mounting structure comprises a pole that extends horizontally.

12. The bracket of claim 8, wherein the mounting structure comprises a flat surface.

13. The bracket of claim 8, wherein the mounting structure comprises a wall.

14. The bracket of claim 8, wherein the bracket is in a family of brackets that comprises:

a first bracket that is configured for attaching the luminaire to a vertically extending pole;

a second bracket that is configured for attaching the luminaire to a horizontally extending pole; and a third bracket that is configured for attaching the luminaire to a wall.

15. The bracket of claim 8, wherein the rear end comprises a curved surface to mount the bracket to a vertically extending pole, and wherein the curved surface has a radius of curvature that substantially matches a radius of curvature of the vertically extending pole.

16. The bracket of claim 8, wherein the rear end comprises a pole receiving aperture and a plurality of set screw receiving holes to mount the bracket to a horizontally extending pole, and wherein the pole receiving aperture receives an end of the horizontally extending pole and is adjusted using one or more set screws inserted through the plurality of set screw receiving holes.

17. The bracket of claim 8, wherein the rear end comprises a rear plate to attach the bracket to a flat surface using a plurality of mounting fasteners.

18. A luminaire comprising:

a frame that is configured to house a light source in a cavity defined by the frame;

wherein a rear end of the frame comprises:

an extension that is integrally formed with the frame and comprising a wire receiving aperture defined by a protrusion formed in the extension, the protrusion comprising two side walls extending on two sides of the wire receiving aperture and a top wall disposed between the two side walls and extending above the wire receiving aperture, and wherein the extension is configured to secure the frame to a bracket-side connector of:

(a) a first bracket when the frame is mounted to a first mounting surface, (b) a second bracket when the frame is mounted to a second mounting surface, and (c) a third bracket when the frame is mounted to a third mounting surface, and wherein the first mounting surface, the second mounting surface, and the third mounting surface are different from each other; and wherein the extension provides the frame with a tongue-and-groove connection for each of the first bracket, the second bracket, and the third bracket.

* * * * *